US006182966B1

(12) United States Patent
Wells et al.

(10) Patent No.: US 6,182,966 B1
(45) Date of Patent: Feb. 6, 2001

(54) LANGUAGE BOARD GAME

(76) Inventors: Gordon Wells; Karen L. Brooks, both of 5213 Lincoln Ave., Whitehall, PA (US) 18052

( * ) Notice: Under 35 U.S.C. 154(b), the term of this patent shall be extended for 0 days.

(21) Appl. No.: 09/421,343

(22) Filed: Oct. 18, 1999

(51) Int. Cl.[7] ..... A63F 3/00
(52) U.S. Cl. ..... 273/236; 273/272
(58) Field of Search ..... 273/236, 242, 273/272, 429, 430, 431, 432

(56) References Cited

U.S. PATENT DOCUMENTS 4,662,635 * 5/1987 Enokian .
4,671,516 6/1987 Lizzola et al. ..... 273/299
4,944,519 7/1990 Canela ..... 273/243
5,207,435 5/1993 Tanner ..... 273/429
5,803,742 9/1999 Buti ..... 434/157
5,906,492 5/1999 Putterman ..... 434/169

* cited by examiner

*Primary Examiner*—William M. Pierce
(74) *Attorney, Agent, or Firm*—Henderson & Sturm LLP

(57) ABSTRACT

A board game including a recorder wherein the object of the game is to pronounce phrases backwards in an effort to have the pronunciation of the phrases sound correct when the tape is played backwards.

15 Claims, 3 Drawing Sheets

80

| Categories | ① | ② | ③ |
|---|---|---|---|
| History | | | |
| Geography | | | |
| SPORTS | | | |
| Entertainment | | | |
| Science | | | |
| Difficult | | | |

LANGUAGE BOARD GAME

BACKGROUND OF THE INVENTION

1. Field of the Invention

The present invention relates to the field of board games, and more particularly to a language board game.

2. Description of the Related Art

As can be seen by reference to the following U.S. Pat. Nos. 4,671,516; 4,944,519; 5,207,435; 5,803,742; and 5,906,492 the prior art is replete with myriad and diverse language board games.

While all of the aforementioned prior art constructions are more than adequate for the basic purpose for which they have been specifically designed, they are uniformly deficient with respect to their failure to provide a simple, efficient and practical language board game utilizing a voice recorder.

As a consequence of the foregoing situation, there has existed a need for a new and improved language board game and the provision of such a construction is a stated objective of the present invention.

BRIEF SUMMARY OF THE INVENTION

Briefly stated, the present invention provides a board game including a recorder wherein the object of the game is to pronounce phrases backwards in an effort to have the pronunciation of the phrases sound correct when the tape is played backwards.

BRIEF DESCRIPTION OF THE SEVERAL VIEWS OF THE DRAWINGS

These and other attributes of the invention will become more clear upon a thorough study of the following description of the best mode for carrying out the invention , particularly when reviewed in conjunction with the drawings, wherein.

DETAILED DESCRIPTION OF THE INVENTION

Figure 1:
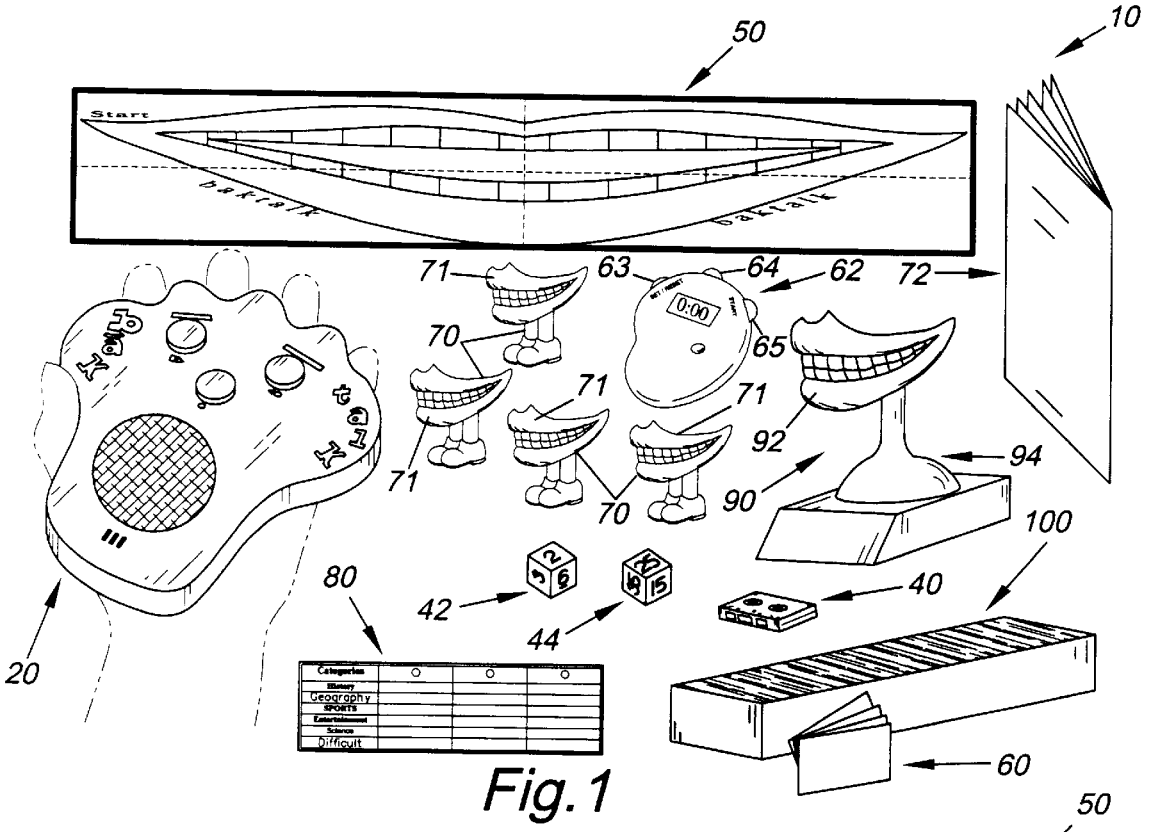
FIG. 1 is a perspective view showing the components of the board game of the present invention.

As can be seen by reference to the drawings, and in particulary to FIG. 1, the language board game that forms the basis of the present invention is designated generally by reference number (10). The board game (10) is made up of several components including a voice recorder (20), recording tapes (40), a standard die (42), a timing die (44), a game board (50), category cards (60), a timer (62), team icons (70), an instruction booklet (72), category tally sheets (80), the winners trophy (90), and a component storage box (100).

Figures 3, 4:
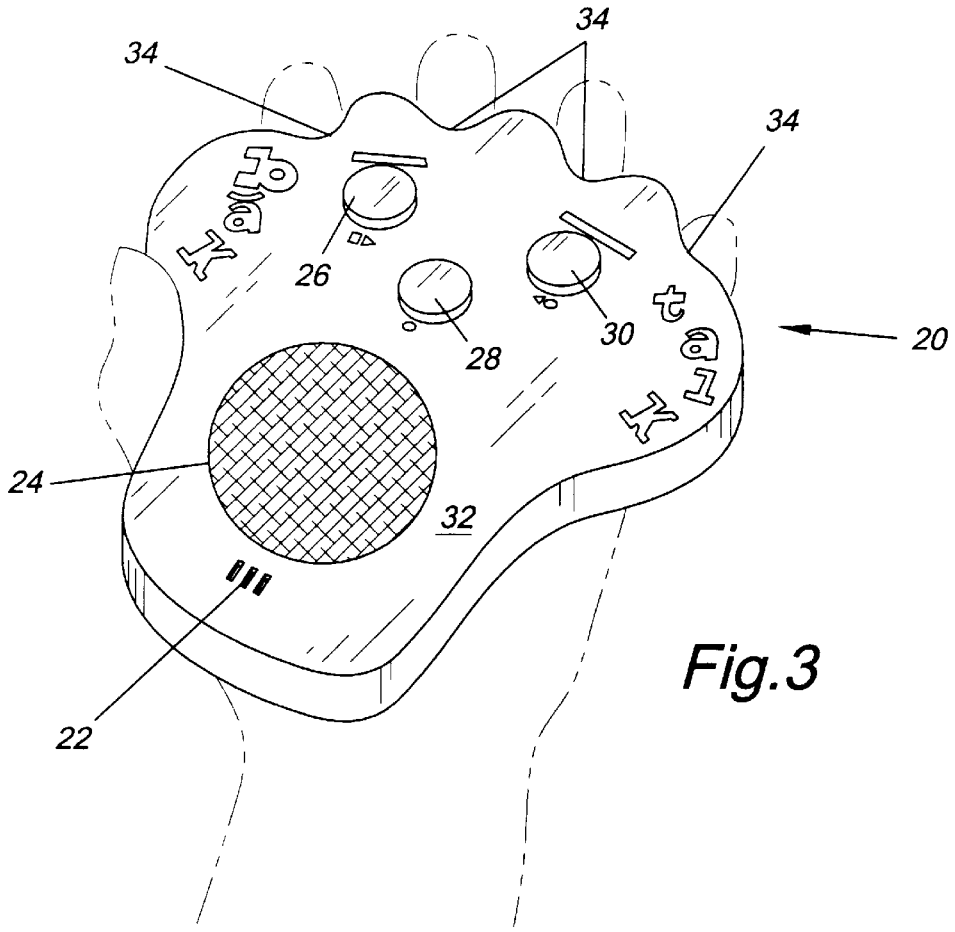
FIG. 3 is a front perspective view of the voice recorder.
FIG. 4 is a top plan view of the category tally sheets.
Figure 5:
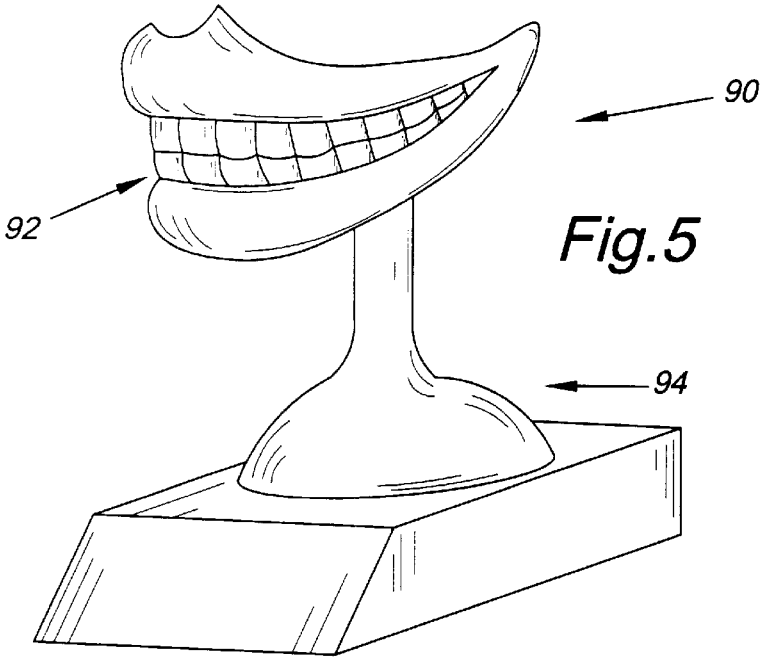
FIG. 5 is a front perspective view of the winner's "mouth" award trophy.
Figure 6:
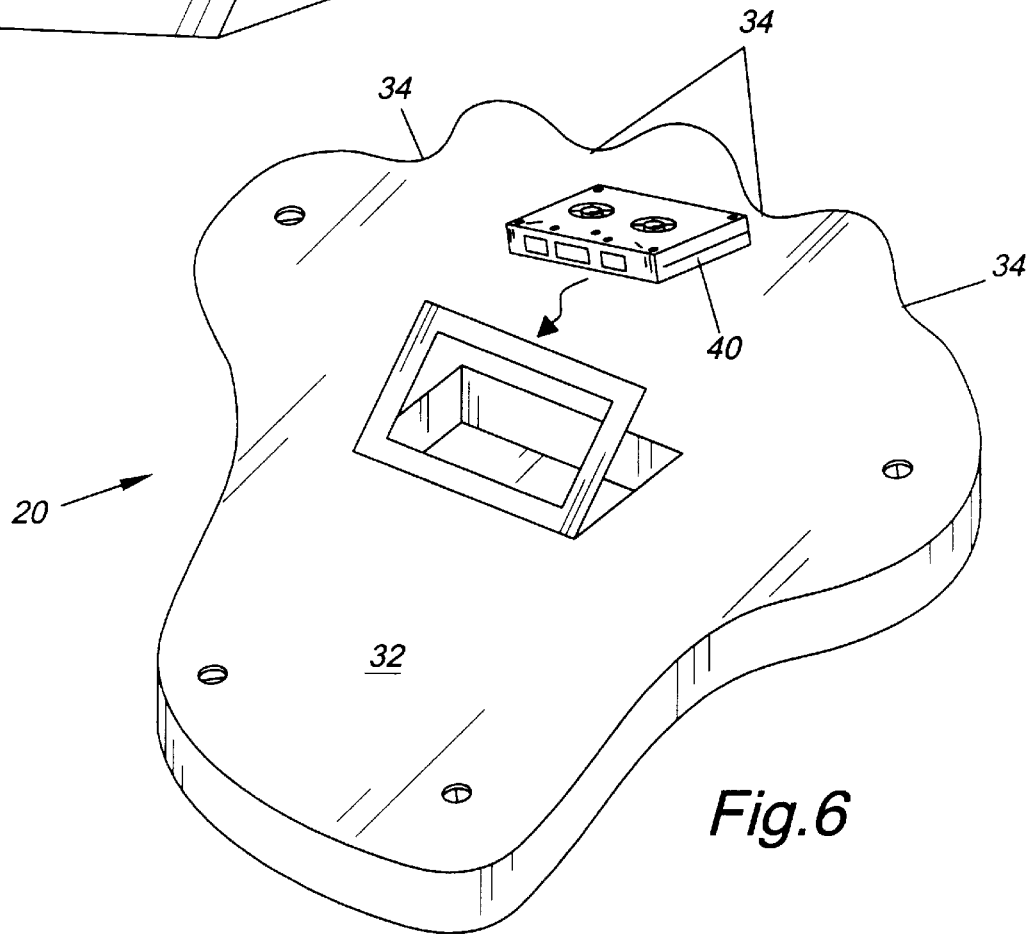
FIG. 6 is a rear perspective view of the voice recorder illustrating a recording tape being inserted.

The voice recorder (20) is a hand held specialized tape recording mechanism made of a predominantly plastic exteral construction with internal plastic and metal tape recording parts as best shown in FIGS. 3 and 6. The recorder (20) includes a built-in microphone (22), speaker (24), play button (26), record button (28) and erase button (30). The record button (28) once pressed will record any voice or sound detected by the microphone (22). Once play button (26) is activated, the mechanism will automatically play the recording backwards. The device's smooth plastic housing (32) is contoured with indentations (34) to fit fingers of either hand making it easy to grip and convenient for play at home or while traveling. The housing (32) is formed in the shape of a talking face with the ears and hair defining the indentations (34).

The recording tapes (40) are identical to those already used in mini-tape recorders and answering machines with a maximum length of approximately 2 minutes. This easy to load audio tape (40) records the player's voice for quick backwards playback by the recording device (20). However, if the technology allows for it, synthesized voice chips could be substituted for this feature.

The die (42) is a standard, hard plastic, six-sided game die for movement of game tokens (70) around playing board (50). The timing die (44) is a hard plastic, 6-sided die displaying numbers between 15 and 40 denoting the amount of seconds a team has to complete their turn; this provides varying challenges throughout the game and keeps the game moving at a reasonable pace. The timing die (44) bears one of the following numbers on a given side: '15', '20', '25', '30', '35', '40'.

Figure 2:
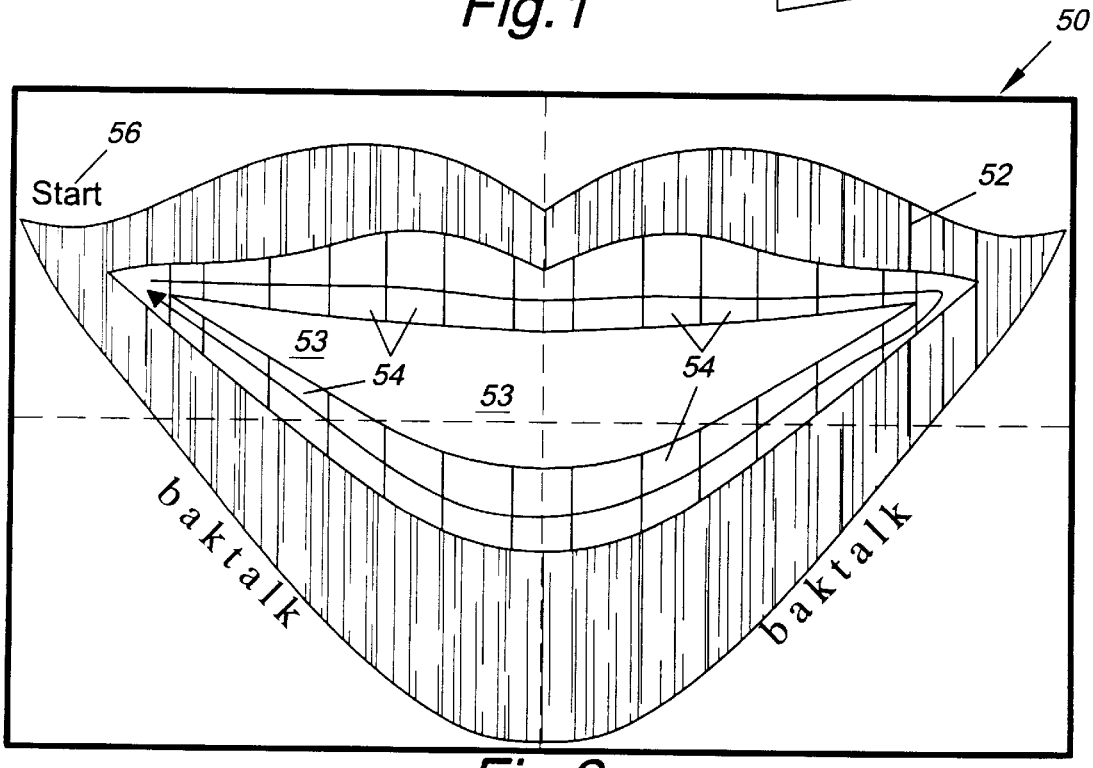
FIG. 2 is a top plan view of the game board.

As best shown in FIG. 2, the game board (50) is a four-piece hinged cardboard playing surface which dictates the mode of play by giving varying instructions on different spaces; this allows contestants to keep track of their progress throughout the game. The board (50) also features a legend as a reference to the category symbols found on the category cards (60). The board (50) includes a representation of a mouth (51), including lips (52), a tongue (53), and teeth (54). Spaces on the lips and the teeth (54) define the path of the team icons (70) as they move from the start position (56) to the finish position at the tongue (53). Some of the spaces also indicate bonus or penalty statements making a team's turn more challenging or easier. However, these statements could be presented via two separate card piles instead of being printed directly on the game board for aesthetic purposes.

Category cards (60) are a set of cardboard cards containing various statements related to designated themes that are to be uttered backwards into the recorder (20). Each card (60) contains one statement from each of the designated six themes. The same set of cards can be used for the varying skill levels of play. Additional sets of cards could be sold separately in later versions of the game. Each card (60) contains six statements or phrases, each related to one of six categories including geography, history, science, sports, entertainment, and difficult phrases.

A card (60), for example may appear as follows:

GEOGRAPHY - North, South and Latin America.
HISTORY - George Washington cut down the cherry tree.
SCIENCE - 'E' equals 'm' 'c' squared.
SPORTS - "The kick is up . . . it's good!"
ENTERTAINMENT - The New York Philharmonic Orchestra.
DIFFICULT PHRASES - She sells sea shells by the sea shore.

Also, the card could employ icons to represent the categories, such as a depiction of mountains for the geography category, a ball for the sports category, etc.

Any short statements or phrases may be used on the cards (60),

For example, phrases related to sports could include:

The Winter Olympics

Thoroughbred Racing

Casey at the bat

Three second violation

"The kick is up . . . it's good"

"Going, going, gone!"

The five hole

Jack Nicklaus, the Golden Bear

Mark McGuire hit home run number 70 as a St. Louis Cardinal

Bjorn Borg wins Wimbledon again

"The thrill of victory, the agony of defeat"

Likewise phrases related to entertainment could include:

"I'm singing' in the rain.."

Metro-Goldwyn-Mayer studios

Raiders of the Lost Ark

"Some enchanted evening, you will see a stranger. . . "

Alfred Hitchcock Presents. . .

The Oscars, the Grammies and the Tonys

The King and I (Rodgers & Hammerstein)

Groucho, Chico, Harpo, Zeppo & Gummo Marx

The New York Philharmonic

South Pacific

"Who ya gonna call? GHOSTBUSTERS!!"

"Hunka, hunka burnin' love. . . "

The timer (62) is a plastic encased L.E.D. timing device having 'set', 'start, and 'reset' buttons (63), (64) and (65), respectively. It can be set in increments of five seconds up to a maximum of 2 minutes, in order to accommodate any time limit established by the rules for a particular team's turn.

The game tokens (70) are plastic molded icons, in one of four colors (red, green, blue, purple), which are manipulated across the game board (50) to represent a team's position during the game in reference to another team's position. It has a humorous design in the shape of "false teeth" (71) with attached legs and sneakers. The Instruction Booklet (72) provides a detailed description of the game's components, rules and object of the game which can also provide variations for the game depending on skill level and give hints to becoming an improved player.

As shown in FIG. 4, the Category Tally Sheets (80) are pads of paper containing a chart of available categories and blank boxes which allows a team to keep track of the frequency in which they've used a certain category. Once a category is exhausted, all other categories must be exhausted before being able to return to that given category.

The winner's trophy (90) is referred to as the "Mouth" Award. It is a miniature plastic molded trophy resembling an exaggerated mouth (92) looking much like the picture on the game board (50). The mouth (92) is mounted on a basic trophy base (94) used as a joke novelty. This "trophy" (90) is given to a designated member of the winning team as a humorous gesture.

Following are the instructions for playing the language board game (10) of the present invention:

"BAKTALK"

Basic Game Playing Instructions

Teams of two or more per side are chosen; highest roll of the die goes first.

Starting team rolls the die and moves their token the appropriate spaces, following the directions on the space where they landed.

A designated teammate (herein referred to as "the mouth") then chooses a game card and picks any one phrase from the card they wish to attempt; once making the choice, the "timing" die is rolled to determine what "the mouth's" time limit will be on that particular turn (unless the space landed on instructs otherwise; e.g., "add 15 sec. to your turn" , "subtract 5 sec. from your turn", etc.); "the mouth" must also mark off one blank space on the category tally sheet in order to keep track of how many attempts were made for a category; once three chances on a category are used up, each team must exhaust all three chances in all other categories before returning to previously used categories. This keeps teams from always using just one category.

The timer is set accordingly by an opposing team.

"The mouth" presses the 'record' button on the recording device and then attempts to speak the chosen phrase in a backwards fashion within the designated time frame. The mouth then presses 'play'. Teammates have fifteen (15) seconds to attempt a guess at the exact answer.

If successful, this team will roll again and continue moving along the spaces. If unsuccessful, the opposing team(s) attempts to guess the exact answer within ten (10) seconds. If the opposing team successfully guesses the answer, they may advance their token via roll of the die. If the opposing team does not successfully guess, they simply stay at their location and take their turn. Play then rotates in this fashion.

The winner is decided by the first team that advances to the finishing space ("the tongue") located-on the game board.

To extend the game and make it more competitive, teams can decide ahead of time if "last chances" will be given to the opposing team(s) still trailing. In this variation, the trailing team(s) must complete all successful turns until they also reach "the tongue" where a sudden death "speak off" occurs. For all teams involved in the "speak off", the die is rolled to see who goes first. The first team that successfully completes a phrase wins with no further "last chances" given.

The "Mouth Award" trophy is then given to the winning team to hold until the next contest is held!

It is to be understood that a "flow chart" of sorts which speaks to the more accurate order of play, could also be included as a separate reference sheet in the game, so players do not always have to comb through the instruction booklet for basic game play rules.

The game challenges players to attempt speaking phonetically backwards. When played back, the outcome can be humorous because all features of the spoken material are produced backwards (e.g. inflection, intonation, etc.). Also, most any type of other spoken word games can be adapted to the format. It could conceivably be a travel game as well.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

We claim:

1. A language board game, comprising:

a game board including a starting position and a representation of a mouth including lips, a tongue, and teeth;

a plurality of movable team icons adapted to be placed on the game board at the starting position and selectively moved along a path defined by the teeth to a finishing position defined by the tongue;

a plurality of game cards, each card including a plurality of phrases, each phrase being associated with one of a plurality of categories; and a voice recorder having a recording mode for recording a selected phrase spoken backward by a player, and a reverse play mode for reverse playing of the selected phrase spoken backward to approximate the selected phrase.

2. The board game of claim 1 wherein the voice recorder includes a housing formed in the shape of a talking face.

3. The board game of claim 2 wherein the housing includes a plurality of indentations to accommodate fingers of the player.

4. The board game of claim 1 further including a six-sided timing die, each side bearing a number indicating an allotted recording time to record the selected phrase spoken backwards.

5. The board game of claim 2 further including a six-sided timing die, each side bearing a number indicating an allotted recording time to record the selected phrase spoken backwards.

6. The board game of claim 3 further including a six-sided timing die, each side bearing a number indicating an allotted recording time to record the selected phrase spoken backwards.

7. The board game of claim 1 further including a category card having a listing of the plurality of categories and a box for entering a notation when a category is selected.

8. The board game of claim 2 further including a category card having a listing of the plurality of categories and a box for entering a notation when a category is selected.

9. The board game of claim 3 further including a category card having a listing of the plurality of categories and a box for entering a notation when a category is selected.

10. The board game of claim 4 further including a category card having a listing of the plurality of categories and a box for entering a notation when a category is selected.

11. The board game of claim 1 further including a trophy including a representation of a mouth similar to the mouth on the game board.

12. The board game of claim 2 further including a trophy including a representation of a mouth similar to the mouth on the game board.

13. The board game of claim 3 further including a trophy including a representation of a mouth similar to the mouth on the game board.

14. The board game of claim 4 further including a trophy including a representation of a mouth similar to the mouth on the game board.

15. The board game of claim 7 further including a trophy including a representation of a mouth similar to the mouth on the game board.

* * * * *